United States Patent [19]

de Somer

[11] 4,315,710

[45] Feb. 16, 1982

[54] COLLATING DEVICE FOR FLAT GOODS, PARTICULARLY CARDS

[75] Inventor: Jean-Marie de Somer, Turnhout, Belgium

[73] Assignee: Carta Mundi, Turnhout, Belgium

[21] Appl. No.: 90,707

[22] Filed: Nov. 2, 1979

[30] Foreign Application Priority Data

Nov. 3, 1978 [BE] Belgium ..... 871738

[51] Int. Cl.[3] ..... B65G 57/30; B65H 31/30

[52] U.S. Cl. ..... 414/47; 271/82; 271/187; 271/212; 414/52; 414/92

[58] Field of Search ..... 414/47, 52, 91, 92; 270/58, 60; 271/82, 187, 212, 220, 315

[56] References Cited

U.S. PATENT DOCUMENTS

| | | | |
|---|---|---|---|
| 2,753,185 | 7/1956 | Johnson | 271/220 |
| 3,088,604 | 5/1963 | Nilsson | 414/47 X |
| 3,674,143 | 7/1972 | Hunter et al. | 414/52 |
| 4,067,568 | 1/1978 | Irvine | 271/212 X |
| 4,134,672 | 1/1979 | Burlew et al. | 414/52 X |

FOREIGN PATENT DOCUMENTS

| | | | |
|---|---|---|---|
| 355162 | 8/1961 | Switzerland | 271/187 |
| 1472444 | 5/1977 | United Kingdom | 270/58 |

*Primary Examiner*—Leslie J. Paperner

*Attorney, Agent, or Firm*—Blum, Kaplan, Friedman, Silberman and Beran

[57] ABSTRACT

On the end of each suction belt (2) are mounted three collecting members (9) standing on an intermittently-rotating shaft (10) and which are comprised of two L-shaped fingers (13). During the collecting the arm (14) of the fingers (13) forms of stop while the arm (15) causes the cards fed to tilt on the end of the suction belt (2). The cards (3) thus collated are pushed due to the revolution of the members (9) by the walls (21) of boxes mounted on a conveyor (17). Moving fingers (27) collate the packages collected in adjacent box rows.

27 Claims, 4 Drawing Figures

COLLATING DEVICE FOR FLAT GOODS, PARTICULARLY CARDS

The invention relates to a collating device for flat goods, particularly cards, which comprises an endless conveyor with at least one conveying strip for the goods.

"Conveying strip" should be understood here in the largest meaning in such a way that it might mean hereinafter both a perforated or unperforated belt or band and one or more chains.

Such devices are notably used for collating playing cards. The cut-out playing cards are located in one or more rows on the top portion of an endless conveying band.

First of all the cards from each row should be collected in groups and in the case of playing cards, it is desired that the collected cards lie in the same sequence as the one in which they were fed by the conveying device. In known collating devices of this kind, use is made of slanting chutes with such a construction that the cards which are fed horizontally are tilted to the vertical position, whereby the various chutes open together in such a way that the tilted cards in the various chutes are finally located vertically against one another. The small packages thus formed in sequence are received on a band running cross-wise to the chutes whereby thus the succeeding packages follow one another vertically. Actually those cards which are fed simultaneously in the various rows are first collected and afterwards only the following cards in the rows. While this per se is not a disadvantage, said known devices have however the following drawbacks: the collating device does not allow obtaining separate packages corresponding to a card set; there is obtained a continuous row of vertically piled cards which have then to be distributed manually in packages corresponding to a set. A second drawback lies in the collating occuring with a limited speed so that the manufacturing speed is not only limited by a linear speed not to be exceeded when cutting, but also due to the collating operation.

The invention has now for object to obviate these drawbacks and to provide a collating device for flat goods, particularly cards, which can operate very fast and whereby the goods are collected in small groups of a well-determined number and according to a well-determined sequence.

For this purpose the collating device comprises at least one collecting member which is mounted facing the one end of the endless conveying strip, to collect the goods to be collated which are fed along the top side of said conveying strip, said collecting member having one portion which forms at least during the collecting of goods, a stop therefor and one portion that stands on the preceding portion and forms relative to the top side of the corresponding conveying strip, an angle to the movement direction of said top side and has a free end which lies at another level than said top side, to cause the goods fed on said top side to tilt around an axis lying cross-wise to the movement direction thereof.

In a particular embodiment of the invntion, the collecting member comprises a clamping mechanism to retain the goods collected against the stop-forming portion, at least temporarily against the other portion.

In an advantageous embodiment of the invention, that collecting member portion which makes an angle at least during the collecting of goods, to the movement direction of the conveying strip top side, depends at least during said collecting, slantingly from said top side and said portion lies with a free end thereof above the end of the conveying device.

In an useful embodiment, the collating device comprises a plurality of endless conveying strips running in parallel relationship, for a plurality of goods rows, and facing the one end of each such strips lies at least during the collecting of goods, a collecting member.

In a preferred embodiment of the invention, the collecting member is so arranged as to be swingable facing the one end of the conveying strip and the collating device comprises means to swing said collecting member at intervals and to retain same in position facing the one end of the conveying strip when collecting.

In another particular embodiment of the invention, the collating device comprises a second endless conveying device which is arranged below the collecting member to collect the series of goods collected by said member, and means to drive said second conveying device.

Other details and features of the invention will stand out from the following description, given by way of non limitative example and with reference to the accompanying drawings, in which.

In the various figures, the same reference numerals pertain to similar elements.

Figure 1:
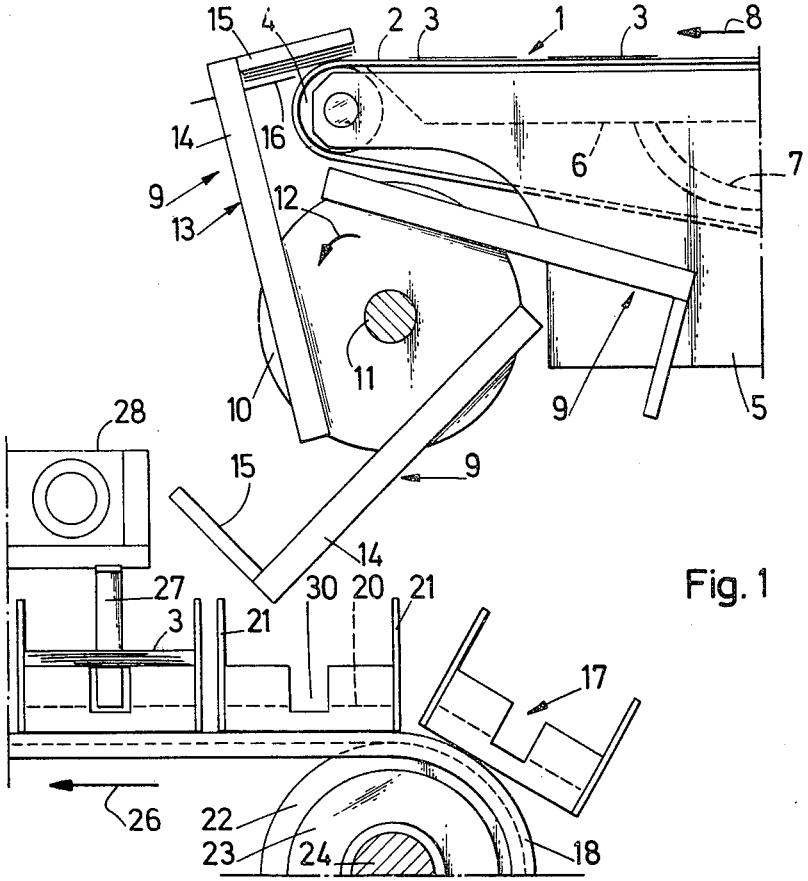
FIG. 1 is a side view of a portion of a collating device for playing cards according to the invention, whereby playing cards are shown.
Figure 3:
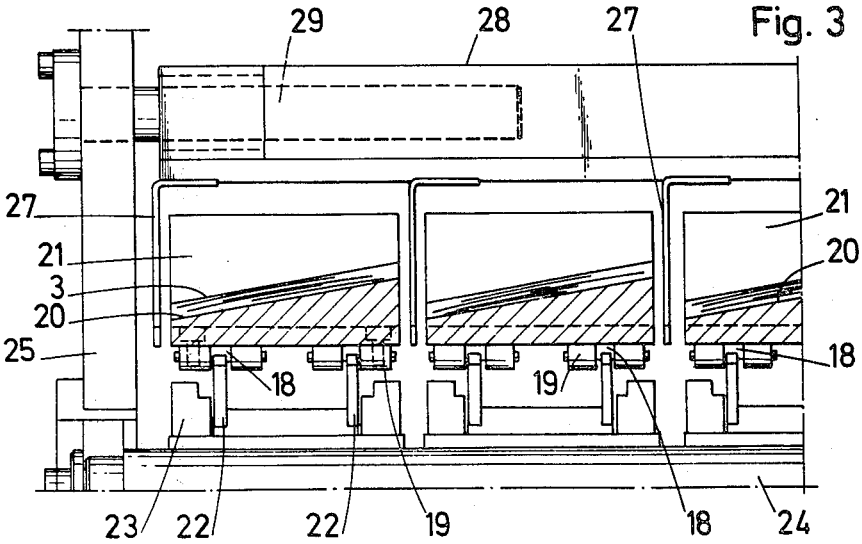
FIG. 3 is a cross-section along line III—III in FIG. 2.

The collating device as shown in the figures comprises an endless feed conveyor 1 which comprises various perforated suction belts 2 for the playing cards 3 to be collated. The suction belts 2 run with the topmost portion thereof horizontal in parallel relationship with one another. The movement direction of said top portion is shown by arrow 8 in FIG. 1. All of the suction belts 2 run at both ends of the conveying device 1, over wheels 4. At the discharge end of the feed conveyor 1, said wheels 4 of the suction belts 2 are each supported separately in an auxiliary frame 5 of their own. At the other end the wheels 4 are arranged on one and the same shaft which is driven preferably intermittently, by a motor not shown in the figures. The topmost portion of each one of said suction wheels 2 runs over a tube-like vacuum chamber 6. The various vacuum chambers 6 are connected through flexible hoses 7 to a vacuum pump not shown in the figures. The vacuum chambers 6 are mounted on the auxiliary frame 5 which belongs to the corresponding suction belt 2. The complete vacuum feed conveyor 1 can be so mounted as to be vertically reciprocable on a main frame not shown in the drawings. This is for example the case when said feed conveyor 1 is part of a collecting and collating device which connects to a discharge device which pushes the cards 3 from top to bottom through a frame, said discharge device connecting in turn to a stamping machine which stamps the cards 3 in a single operation from a sheet. For discharging through the discharge device and in the stopping stage of the platten in said device, the feed conveyor 1 lies in the topmost position thereof and against the discharge punch in such a way that the discharged cards 3 are directly positively sucked by the suction belts 2 and consequently always take an accurately determined position in which they remain during the movement thereof.

When the collating device connects to a stamping machine and a discharge device, and when for example four card sets are printed in twelve rows of eighteen cards on one sheet, the feed conveyor 1 comprises twelve suction belts 2. At each discharge, eighteen cards 3 are collected on each suction belt 2, said eighteen cards being first collated in a package and afterwards the twelve package have to be collated again into one or more larger packages.

For this purpose the collating device comprises facing the discharge end of each suction belt 2, three collecting members 9 which are rotatable about a horizontal geometric axis which is directed cross-wise to the movement direction of the suction belts 2 as shown by arrow 8. Said three collecting members 9 are made fast to a horizontal shaft 10 which thus runs in the direction of the rotation axis. Said three collecting members 9 are evenly distributed over the circumference of said shaft 10 and they all lie in a plane which is directed at right angle to the rotation axis. The axis is common to all of the series of three collecting members 9 facing the various suction belts 2 in such a way that said shaft 10 thus runs over the whole width below the discharge end of the feed conveyor 1. Said shaft 10 is supported with ends of smaller cross-section 11 in the above-mentioned main frame, not shown in the figures.

Each one of said collecting members 9 comprises two bent fingers 13 of L-shape which lie next to one another along the lengthwise direction of shaft 10, with a spacing which is somewhat larger than the width of the corresponding suction belt 2. Said fingers 13 are however so located that due to the rotation of shaft 10, the revolution direction of which is shown in FIG. 1 by arrow 12, they move on either side of the corresponding suction belt 2 and consequently also of the wheel 4 and the auxiliary frame 5 which supports said belt at the discharge end thereof.

It is clear that due to all of the fingers 13 being fast to the same shaft 10 and thus moving together, those two fingers 13 which are part of two adjacent collecting members 9 and move between two adjacent suction belts 2 may be united into a single finger. With a portion 14 each one of both fingers 13 of a collecting member is eccentrically made fast to shaft 10. The other portion 15 at right angle to the above arm of each one of both fingers 13 connects to the one end of portion 14. The portions 15 of all of the fingers 13 of all of the collecting members 9 lie with the free end thereof along the same direction, that is in that direction opposite the revolution direction of shaft 10 as shown by arrow 12. Actually there is obtained some kind of three-armed swastika whereby the cross arms are however not directed radially relative to the center thereof.

Both L-shaped fingers 13 from each collecting member 9 thus halved, project over such a distance and at such an angle outside shaft 10 that they project with the portion 15 thereof on either side of the discharge end of suction belt 2 exactly above the topmost portion of said suction belt 2, at least in the lowermost position of said belt 2 pertaining to member 9 when the suction belt is movable vertically.

The rotation of shaft 10 is obtained intermitenttently by means of a motor not shown in the figures, whereby during the collating one collecting member facing each suction belt 2 lies every time in a position whereby the portions 15 of the fingers 13 thereof take the above-described position.

The portions 15 of both fingers 13 form a collecting member lie in the latter position whereby they thus lie above the one end of the pertaining suction belt 2, at an angle to the topmost portion of said suction belt 2. Said portions 15 run downwards away from said end. In the above-mentioned position, whereby the collecting member 9 stands still for a time to collect cards 3, that end removed from portion 14 of said portion 15 still lies some distance above the top side of suction belt 2.

The first card 3 which is fed after the collecting member 9 has reached its position, by a suction belt 2 will engage the portions 15 of both fingers 13 from that collecting member 9 pertaining to the suction belt and is forced by said portions 15 to make an angle to the top side of the suction belt 2. Said card is moved up against portions 14 that section of which projecting outside shaft 10 forms a stop. The arrangement of both portions 14 form a collecting member 9 on the shaft 10 and the location of said shaft 10 relative to the feed conveyor 1 are such that in the above-mentioned position whereby member 9 collects cards, the stop-forming section of portions 14 lies at a distance from the end of suction belt 2 which is shorter than the size of a card 3 as measured along the direction of arrow 8 in such a way that the card 3 as it engages portions 14, still bears with a portion thereof on the end of suction belt 2 and the end thereof removed from portions 14 slants upwards and is raised from the top side of the topmost portion of suction belt 2. A following card 3 which is fed by suction belt 2 will be slipped automatically below said latter-mentioned card 3 whereafter also this card 3 will be forced by portions 15 of member 9 to take a slanting position and to lie against the preceding card 3. In this way a series of cards 3 fed by one suction belt 2 is collated in succession into a small package whereby each time a following card is slipped below a preceding card.

It is clear that to be able to cooperate with both fingers 13 from a collecting member 9, those cards 3 which are fed by the pertaining suction belt 2, have to project on either side outside said suction belt 2. The suction belt 2 has consequently a width which is substantially smaller than the size of the cards 3 as measured at right angle to the direction of arrow 8. The cards 3 are mostly laid with the cross-wise direction thereof along the movement direction of suction belt 2. In this way there is thus collated in the corner formed between the guide-forming portions 15 and the stop-forming portions 14 of both fingers 13 of the collecting member 9 opposite each suction belt 2, a small package of playing cards 3.

To prevent that due notably to the rotation of shaft 10 and collecting member 9, said package should fall down, each collecting member 9 further comprises a clamping mechanism which is shown generally in 16. Said clamping mechanism comprises for each finger 13 of the collecting member 9, a spring wire which is fast to portion 14 and which extends along portion 15 of finger 13.

When a large enough number of cards 3 fed on each one of the suction belts 2 has been collated below that collecting member 9 pertaining to each suction belt 2, the shaft 10 swings over such an angle that then a following collecting member 9 takes the position of the preceding member and collates in the way described above a second series of cards 3. While this occurs, the piles of cards 3 remain due to the clamping mechanism 16 on the first-mentioned collecting members 9. When the second series of collecting members 9 has also collated enough cards 3, the shaft 10 swings again whereby now the third series of collecting members 9 is located facing the discharge end of the suction belts 2.

Figure 2:
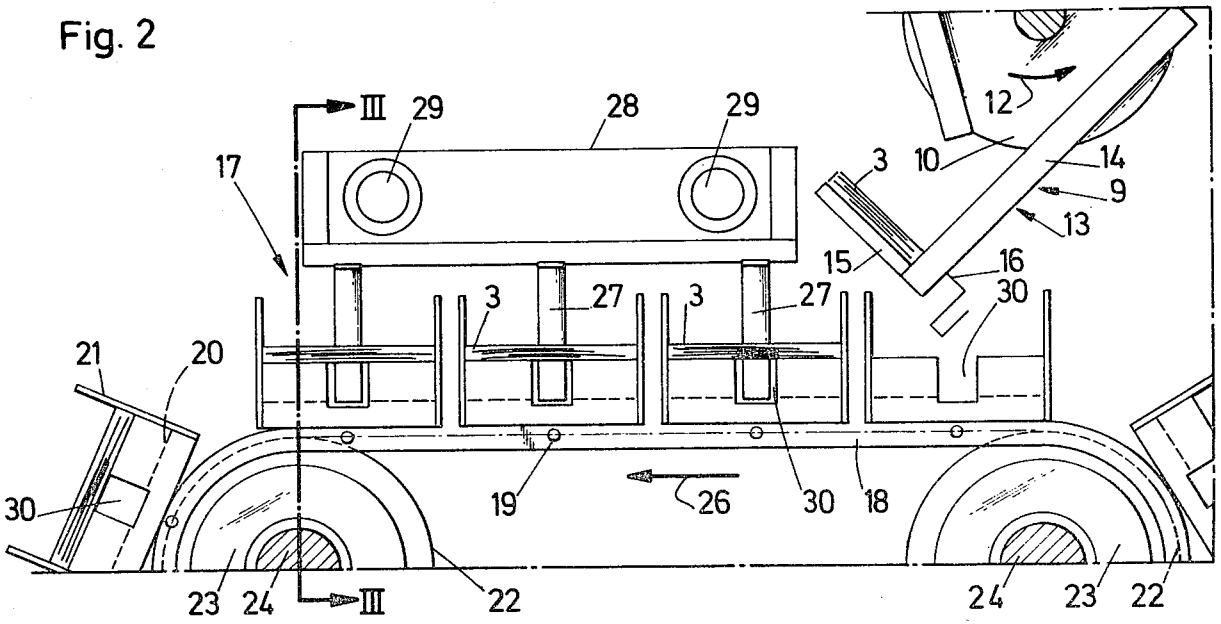
FIG. 2 is a side view of another portion of the collating device from FIG. 1.
Figure 4:
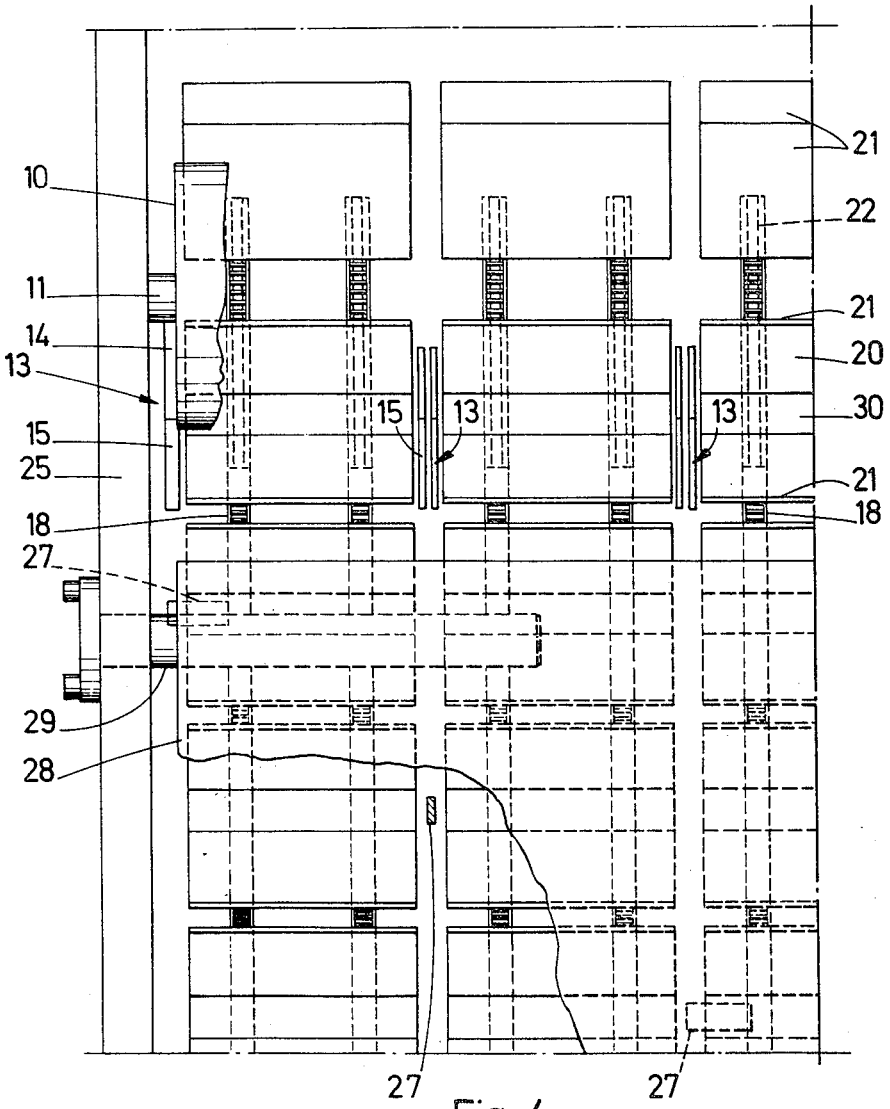
FIG. 4 is a top view of a portion of the device shown in FIGS. 1–3.

Below the complete array of collecting members 9 is arranged a second endless conveyor 17. Said conveyor 17 comprises for each suction belt 2 of the feed conveyor 1, a pair of endless chains 18 between which are secured small boxes formed by a bottom 20 and two walls 21 standing thereon. The walls 21 are directed outwards relative to the conveyor 17 and stand crosswise to the endless chains 18. The boxes 20, 21 are consequently open sideways relative to the lengthwise direction of the chains 18. The boxes 20, 21 are secured with the bottom 20 thereof through hinges 19 to the links of the chains 18. Said endless chains 18 from each pair each run at both ends of the conveyor 17 over a chain wheel 22 which is made fast by means of circlips 23 to a shaft 24. Said shaft 24 on which all of the chain wheels 22 at the one end of conveyor 17 are mounted, is supported with both ends thereof in a frame 25 which may actually be integral with the above-mentioned main frame (not shown) wherein the shaft 10 is supported. The shaft 24 at each end of conveyor 17 runs in parallel relationship with said shaft 10 whereby the one shaft 24 is located below said shaft 10. The topmost portion of the chains 18 moves horizontally, away from the latter-mentioned shaft 24 along the same direction as the topmost portion of suction belt 2. The movement direction of the chains 18 and thus also of the boxes 20, 21 mounted thereon is shown in FIG. 2 by arrow 26.

The topmost portion of the endless conveyor 17 is thus comprised of as many rows of boxes 20, 21 running along the movement direction of the chains 18 as there are suction belts 2, whereby each row is located below a suction belt 2 and runs further way along the same direction as the suction belt 2. When the collating device comprises twelve suction belts 2, it does also comprise twelve rows of small boxes 20, 21. Said boxes 20, 21 from adjacent rows also lie directly next to one another in such a way that columns are thus formed. The number of columns, that is thus the number of boxes 20, 21 present in one row completely on the topmost portion of a pair of endless chains 18, is one more than the number of rows. When the collating device operates, at each swinging of shaft 10 a package of cards 3 from a collecting member 9 is collected in each box 20, 21 of that box column that lies at the end lying below shaft 10 of the topmost portion of endless conveyor 17. During such collecting, the conveyor 17 lies stationary. The card package is pushed away from the portion 15 of both fingers 13 from a collecting member 9, through a wall 21 of a box 20, 21 proper during a revolution of the collecting member unit. The length of wall 21 is always approximately equal to the width of a suction belt 2 and consequently may fit precisely between both fingers 13 from member 9. There appears clearly from FIGS. 1 and 2 that portion 15 from a collecting member 9 in the lowermost position thereof, is located below the lowermost edge of the back wall 21 of that box 20, 21 which lies precisely below said collecting member 9 at the top side of the conveyor 17. In this way when the collating device is completely in operation, at each swinging between two stoppings of shaft 10 with the collecting members 9, the card package already collected on a collecting member 9 is pushed into a box 20,21.

As soon as each one of said boxes 20, 21 has received a card package, the conveyor is moved over a small distance in such a way that a new column now comes to lie in the location of the preceding column. The card packages from the first column are now brought together step by step between each movement of the endless conveyor 17.

Said bringing together occurs by means of fingers 27 which are secured to a bearing plate 28. Said bearing plate 28 runs in parallel relationship above the topmost portion of endless conveyor 17 and is alternately movable at right angle to the movement direction of said topmost portion as shown by arrow 26. Said bearing plate 28 lies with both sides thereof which are directed at right angle to the movement direction thereof, slidingly on two shafts 29 which are thus directed along the movement direction of the bearing plate 28 and thus run in parallel relationship to shafts 24. Said shafts 29 are fast to the frame 25. The alternating sliding of the bearing plate 28 may be obtained in any known suitable way. The bearing plate 28 may for instance be secured to a tube which fits on a rotating shaft which is provided with a sinusoidal groove, while a pin goes through the tube to enter with one end thereof said groove to thus follow said groove path during the revolution of said shaft.

The number of fingers 27 which are fast to the lower side of bearing plate 28 is equal to the number of rows of small boxes 20, 21 but one. All of the fingers 27 lie on one line which lies in diagonal above the topmost portion of the endless conveyor 17. In the rest position a finger lies precisely next to the box 20, 21 which lies in the second position as considered along the box movement direction, on the topmost portion of an outermost box row and a following row of boxes 20, 21, directly next to the third box 20, 21 from the latter-mentioned row. The following third finger lies between the latter-mentioned row and the third row of boxes 20, 21, directly next to the fourth box 20, 21 from the latter-mentioned row, etc. The alternating movement of the bearing plate 28 with the fingers 27 is precisely equal to the width of a box row. In othe words during the forward movement, a finger 27 can push a card package from a box 20, 21 from the first row towards the adjacent box from the following row. Nothing happens during the return movement. The possibility for the fingers 27 to push card packages away from the boxes 20, 21 results from said boxes being open in the movement direction of said fingers 27, that is thus along the width direction of endless conveyor 17, and from said fingers reaching down to the box bottom 20. Said box bottom 20 is provided for this purpose with a groove 30 running along the finger movement direction, in such a way that the lowermost end of a finger running therethrough can surely reach down to below the lower side of the card package laying on said bottom 20.

As the various cards should be collated by the fingers 27 with the correct sequence and thus the one package should fall smoothly over the other one, the top side of bottom 20 in all of the boxes 20, 21 slants along the movement direction of the fingers 27, but for groove 30, upwards along the movement direction of the fingers 27 as they take along a card package.

The movement of bearing plate 28 together with the fingers 27 occurs every time the endless conveyor 17 stands still. At the first stopping of the endless conveyor 17, all of the boxes 20, 21 in a column lying at the end of the device collect a card package. At the following stopping the card package inside a box 20, 21 lying at the end of said one location-removed column, is displaced by a finger 27 over one row in such a way that said package falls down on that package which is already present in the box from said column lying in the second row. At the following stopping of the endless conveyor 17 the same operation occurs due to the following finger 27. Both latter-mentioned card packages which are already assembled inside a box 20, 21 in the second row, are no brought by the fingers above that package which is already present inside that box 20, 21 which is located in the third row. It is clear that in this way at the discharge end of the endless conveyor 17, all of the card packages which were collected in one column of small boxes 20, 21, in other words all of the cards which Have for instance been stamped from one sheet, one assembled into one large package.

It is also clear that with a suitable selection of the number and position of the fingers 27, it is also possible to collate all of the packages which have been collected in one column of boxes 20, 21, into a plurality of smaller packages instead of one large package. When for instance the finger 27 is dispensed with between the third and fourth box row, only those card packages from those boxes 20, 21 lying in one column which are also lying in the first four rows will be collected and there is then obtained at the discharge end of the endless conveyor 17 a package formed on the fourth row by four small packages from a box 20, 21.

It is thus possible by the suitable selection of the sequence according to which the cards are fed by the suction belts 2, which is for example dependent on the way the cards have been printed on the stamped-out sheet, to obtain at the collating device outlet small piles comprising each but one play set wherein moreover the cards are distributed in the desired sequence. The operation is always such that all of the cards fed on one suction belt 2 are first collated in a well-determined sequence and thereafter the small packages already collated by all of the suction belts 2 in a determined sequence are assembled by the endless conveyor 17 and the fingers 27 also according to a well-determined sequence.

It must be understood that the invention is in no way limited to the above embodiments and that many changes can be brought therein without departing from the scope of this patent.

For instance the collating device does not have necessarily to collate playing cards, it may also be used to collate beer pads or other flat goods.

The number of catch members which are mounted on the shaft should not necessarily be three for each suction belt. One member is already sufficient.

The collecting members should not necessarily either be mounted to swing about a horizontal axis. They could also be swingable about a vertical axis and they might even not be swingable at all. In that case where the collecting members are fixed, other means should of course be provided to push the goods collected by the collecting member away therefrom in place of the described means. Such pushing away may for example be performed with a movable punch.

When the collecting members stand still, are swingable over but a limited angle about a horizontal axis or are swingable about a vertical axis, they do not have absolutely to be divided in two parts, namely two fingers.

That portion of the collecting members which causes the collected members to tilt shold not absolutely either run downwards away from the feed conveyor. Said portion might also slant in the other direction.

I claim:

1. A collating device for flat goods, particularly cards, comprising:

an endless conveyor with at least one conveying strip for bearing said goods, said flat goods being fed along the top side of said conveying strip;

at least one collecting member mounted facing a discharge end of said endless conveying strip to collect said goods leaving said conveying strip to be collated, said at least one collecting member having a first portion, said first portion at least during the collecting of goods, being a stop therefor, and a second portion connected transverely to said first portion and positioned relative to said top side of said conveying strip at an angle to the movement direction of said top side, said second portion having a free end which is spaced apart from said top side leaving a gap between said top side and said free end, said goods fed on said top side passing through said gap and striking said second portion and tilting about an axis transverse to the movement of said conveying strip;

a clamping mechanism to retain said goods at least temporarily against said second portion, said goods being stopped against said first portion and forming an angled surface of said gap;

means for positively retaining said flat goods on said at least one conveying strip for movement therewith while said conveying strip bears said flat goods on said top surface to said discharge end, said conveying strip and associated means for retaining driving said goods beyond said discharge end and against one of said second portion and said goods forming said angled surface of said gap, said flat goods being collated in a stack between said second portion and said clamping mechanism, the flat goods discharged from said strip being forced between said preceeding collated goods and said clamping mechanism, said last discharged goods displacing the position of said preceding goods in said stack of collated goods.

2. Collating device as defined in claim 1 in which said means for positively retaining is a vacuum chamber and the conveying strip is a suction belt which runs over said vacuum chamber, said chamber being provided with openings, and further comprising means to retain a vacuum inside said chamber.

3. Collating device as claimed in claim 1, in which the feed conveyor comprises simultaneously the collecting device for a discharge device mounted at the outlet of a stamping machine and discharging from top to bottom, said feed conveyor collecting the goods stamped from a sheet and pushed by said discharge device downwards through a frame.

4. Collating device as defined in claim 3, in which the feed conveyor is movable up and down in such a way that the topmost portion thereof lies in the highest position thereof during the stationary step of the discharge device platten, against the discharge punch.

5. Collating device as claim 1, in which the goods are comprised of playing cards.

6. A collating device as claimed in claim 1, wherein said clamping mechanism comprises a spring element, said spring element being mounted on said first portion and extending adjacent to said second portion.

7. A collating device as claimed in claim 6, wherein at least during the collecting of goods said second portion lies with the free end thereof above the end of said conveying strip.

8. A collating device as claimed in claim 1, wherein both portions of said collecting member are directed at a right angle to one another.

9. A collating device as claimed in claim 1, wherein said conveyor comprises a plurality of endless conveying strips running in parallel relationship, forming a plurality of goods rows, and facing the discharge end of each said strips is positioned, at least during the collection of goods, a collecting member.

10. A collating device as claimed in claim 1 or 9, wherein said at least one collecting member is rotatable, and further comprising means to rotate said at least one collecting member at intervals of time and to retain said at least one collecting member in position facing said discharge end of said associated conveying strip when collecting.

11. A collating device as claimed in claim 10, wherein said collecting members are mounted on one shaft for rotation.

12. A collating device as claimed in claim 11, wherein said collecting members are rotatable over 360 degrees.

13. A collating device as claimed in claim 12, wherein said collecting members are rotatable about a horizontal axis directed at a right angle to the direction of movement of said top side of said associated conveying strip.

14. A collating device as claimed in claim 10, wherein said first stop-forming portion and said second portion of said collecting member is divided into two elements, said elements being spaced by a distance larger than the width of said discharge end of the associated conveying strip, said conveying strip having a width which is less than the width of said goods conveyed thereon, said goods projecting with two ends beyond said conveying strip, said two collecting member elements collecting said goods at said projecting ends.

15. A collating device as claimed in claim 14, and further comprising means for pushing said goods collated in said collecting member away from said collecting member.

16. A collating device as claimed in claim 15, wherein said means for pushing said goods collected by said collecting member away from said collecting member comprise a stop, said stop fitting between both elements of said divided collecting member during the intermittent rotation of said collecting member.

17. A collating device as claimed in claim 16, and further comprising a second endless conveying device arranged below said collecting member to collect a series of goods collected by said member, and means for driving said second conveying device.

18. A collating device as claimed in claim 17, wherein said second endless conveyor comprises walls projecting outside said conveyor, said walls forming compartment adapted to hold therein in a series of goods.

19. Collating device as defined in claim 18, in which the stop for pushing goods collected by a collecting member away from said member, is the wall from a compartment.

20. Collating device as defined in claim 18, in which the second endless conveyor is located below all of the collecting members opposite said strips, said second conveyor extending along a direction whereby the top side thereof extends along the lengthwise direction of the topmost portion of said strips, and said second conveyor comprises for each strip a compartment row, said compartments coming to lie in succession below the collecting member which cooperates with said strip.

21. Collating device as defined in claim 20, in which said compartments are open sidewise relative to the movement direction thereof and the collating device further comprises at least one finger and means to move said finger cross-wise to the compartment movement direction, in such a way that said finger collates goods collected in those compartments lying next to one another from different rows.

22. Collating device as claimed in claim 21, in the bottom walls of the compartments is provided a groove running cross-wise to the movement direction thereof and through which can move the lowermost end of said finger.

23. Collating device as defined in claim 22, in which the compartment bottom walls slant at the top edge thereof in the same direction cross-wise to the movement direction thereof.

24. Collating device as defined in claim 23, which comprises a plurality of fingers while the means to move the finger move alternately all of said fingers together over a distance which is equal to the width of a compartment row extending along the compartment movement direction, and whereby at least to a number of columns of adjacent compartment lying cross-wise to said movement direction belongs a finger and the finger from two adjacent columns among said cross-wise columns is moved over a compartment row running along the movement direction.

25. A collating device as claimed in claim 21, wherein said compartments are aligned in a plurality of columns transverse to said compartment rows and each said finger associates with a particular row and column, said fingers being in a line and adapted to move by a distance transverse to said rows equal to the width of one compartment row, said fingers when moved pushing the goods from one compartment into the compartment in the adjacent row, goods from a plurality of adjacent rows being accumulated in one compartment, said plurality of rows for accumulation in one compartment equalling the number of consecutive adjacent rows having a finger associated therewith, and further comprising means for moving said fingers.

26. A collating device as claimed in claim 18, wherein said means for driving said second conveying device drives said second conveyor intermittently, said means for driving being adapted to hold still a compartment when a series of goods collected by said collecting member is pushed by said means for pushing the goods away from the collecting member.

27. Collating device as claimed in claim 26, wherein said second conveyor further comprises between both walls bounding a compartment a bottom wall and the compartments thus form small boxes.

* * * * *